US007484274B2

(12) United States Patent
Nelson et al.

(10) Patent No.: US 7,484,274 B2
(45) Date of Patent: Feb. 3, 2009

(54) FREE END BAND AND SEAL

(75) Inventors: Daniel J. Nelson, Denver, CO (US); Douglas J. Ingalls, Bailey, CO (US); Bai Kiet Tran, Denver, CO (US); Dan Grant, Centennial, CO (US); Brian Swetlic, Arvada, CO (US); Mark Mossbrucker, Littleton, CO (US); Rene Leist, Denver, CO (US)

(73) Assignee: Band-It-IDEX, Inc., Denver, CO (US)

( * ) Notice: Subject to any disclaimer, the term of this patent is extended or adjusted under 35 U.S.C. 154(b) by 49 days.

(21) Appl. No.: 11/422,854

(22) Filed: Jun. 7, 2006

(65) Prior Publication Data

US 2006/0272133 A1 Dec. 7, 2006

Related U.S. Application Data

(60) Provisional application No. 60/688,485, filed on Jun. 7, 2005.

(51) Int. Cl.
*B65D 63/04* (2006.01)
*B65D 63/06* (2006.01)
*B65D 63/02* (2006.01)

(52) U.S. Cl. ..... 24/20 R; 24/23 B; 24/703.1

(58) Field of Classification Search ..... 24/30.5 R, 24/20 TT, 703.1, 703.2, 23 R, 23 W, 23 B, 24/16 PB; 292/307 R, 325, 307 B, 328
See application file for complete search history.

(56) References Cited

U.S. PATENT DOCUMENTS 155,413 A * 9/1874 Boisseau ..... 24/21
2,046,634 A * 7/1936 Johnson ..... 24/23 W
3,117,812 A * 1/1964 Brooks et al. ..... 292/311
3,964,133 A * 6/1976 Wasserlein, Jr. ..... 24/23 R
4,128,919 A * 12/1978 Bulanda et al. ..... 24/20 TT
5,488,760 A * 2/1996 Jansen ..... 24/16 PB
5,732,446 A * 3/1998 Blanks ..... 24/25
6,122,804 A * 9/2000 Gamaggio-Schafer ..... 24/25

OTHER PUBLICATIONS

Strapping, Stretch Wrapping and tape Protection Packaging Systems Catalog, Signode, May 8, 2007, 4 pages.

http://www.certifiedslings.com/catalog/8-SteelStrappingSealsTools.shtml, Certified Slings and Supply website, 2006, 2 pages.

http://www.moderninternational.com/strapping/steel.htm , Modern International Corporation website, site believed first on the web May 5, 2002, 4 pages.

* cited by examiner

*Primary Examiner*—Robert J Sandy
(74) *Attorney, Agent, or Firm*—Sheridan Ross P.C.

(57) ABSTRACT

A pre-cut and preformed free end band and seal of a predetermined length, and method of making and using the same is disclosed. The band is preformed with a substantially closed loop of band material to capture a seal to provide a preassembled band and seal wherein the seal is generally inhibited from being dislodged during packing, shipment, handling and installation. The band and seal are also formed in a manner to facilitate relative positioning of the band and seal as well as placement of a crimping tool relative to the band and seal for optimized crimping of the band and seal.

12 Claims, 10 Drawing Sheets

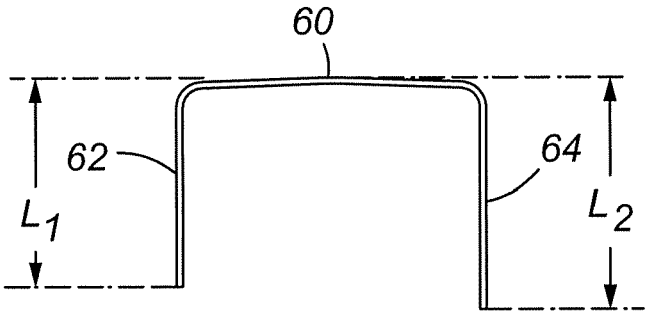
Fig. 7
Fig. 8
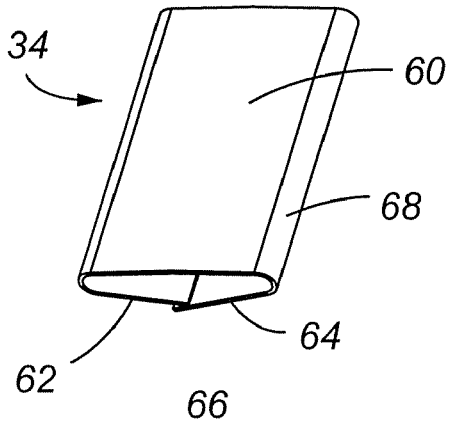
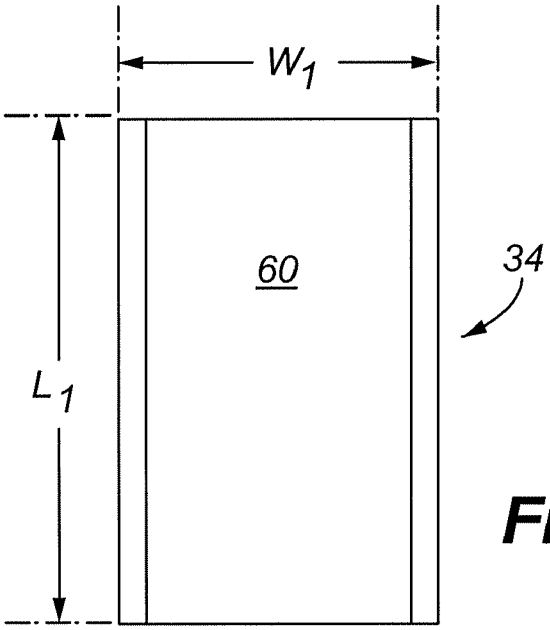
Fig. 9
Fig. 10A
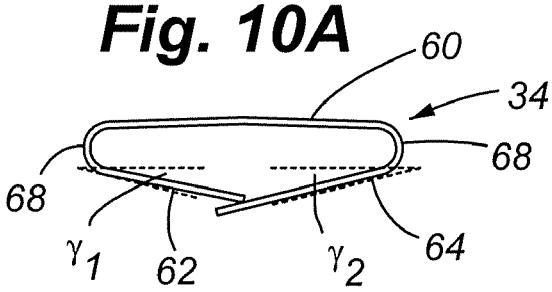
Fig. 10B
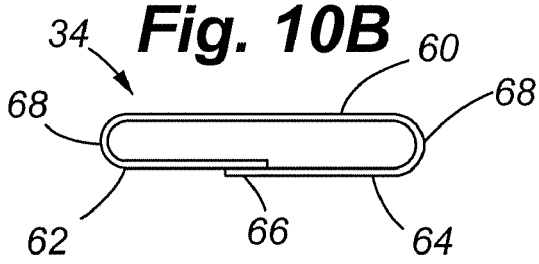

Fig. 17
Prior Art
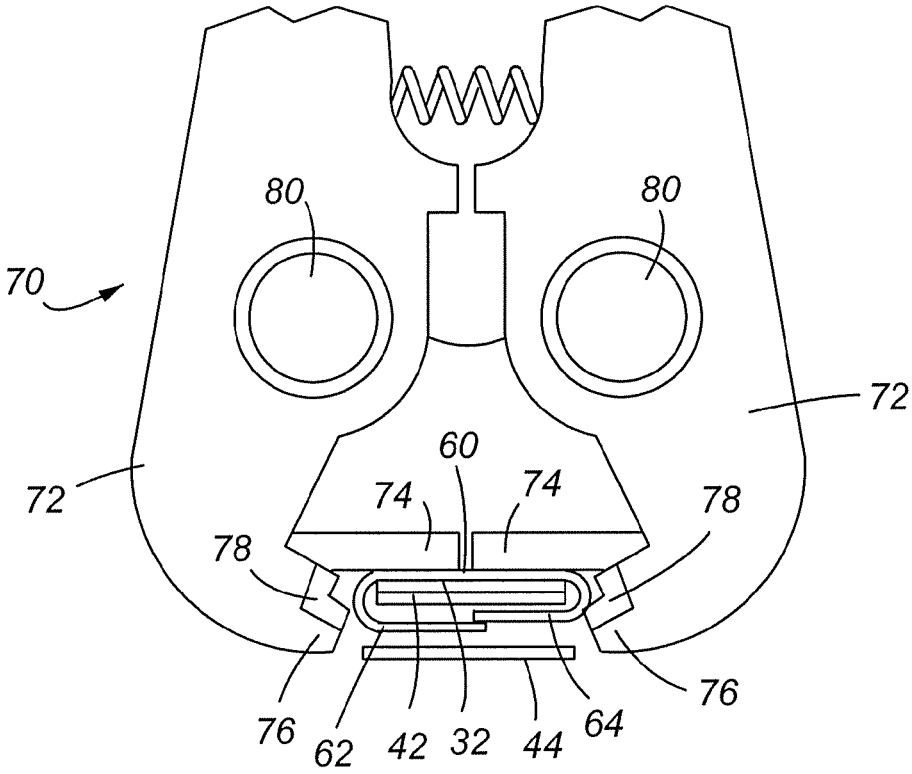
Fig. 18
Prior Art
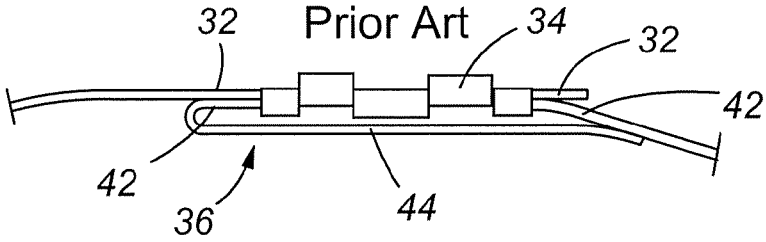
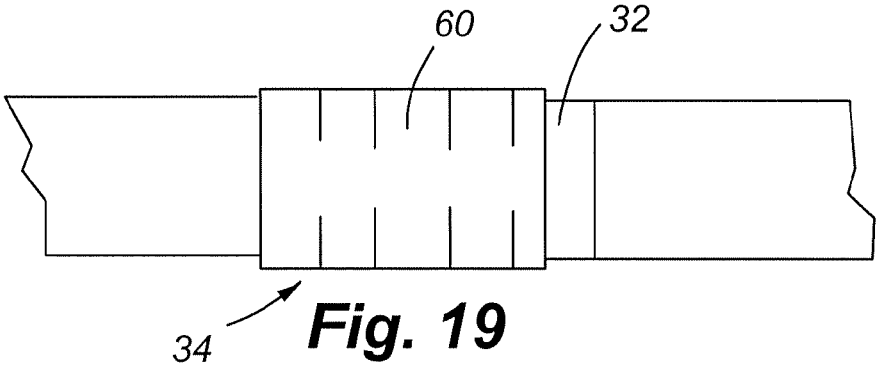
Fig. 19
Prior Art

FREE END BAND AND SEAL

CROSS REFERENCE TO RELATED APPLICATION

The present application claims the benefit, under 35 U.S.C. § 119(e), of U.S. Provisional Patent Application Ser. No. 60/688,485 filed Jun. 7, 2005, entitled "Free End Tie and Clamp," the entire content of which is incorporated herein reference in its entirety.

FIELD OF THE INVENTION

The present invention relates to banding and restraining large objects, in many instances where the objects are difficult to access and where the objects are exposed to extreme environmental conditions. More particularly, the invention relates to a method of making an improved preformed band with a band formed with a captured seal, the resulting band and seal combination, and the method of using the same.

BACKGROUND OF THE INVENTION

Band clamps come in a variety of shapes and sizes and are used to secure or restrain one or more objects, also of varying size depending upon the application. In some applications, the bands are relatively small, for example when clamping hoses and fittings in automotive or aerospace applications or bundling wiring cables in electrical applications. Small bands may have a width in the range of 0.125 to 0.50 inches and a thickness in the range of approximately 0.010 to 0.030 inches. In the case of such relatively small bands, a buckle is typically preassembled on the band. The band is typically bent or deformed in some way to secure the buckle. Although the buckle may be removed, the band must be inelastically deformed to do so. These products are referred to as ties and examples of these products are sold under the trademark Tie-lok®. Buckles can also be formed as an integral part of a one-piece band. Exemplary products are sold under the names Tie-Dex and Band-Lok. The buckle is typically not deformed when securing the band about one or more objects.

In comparison, some applications require larger bands. For example, some larger bands range from 0.75 to 1.25 inches in width, and have a thickness in the range of approximately 0.030 inches. These larger bands use a seal, rather than a buckle, to secure the band about one or more objects. Unlike ties, both the band and seal are deformed to secure the band about one or more objects.

Small and large band clamps are also installed in a variety of environments. In some environments, such as indoors, it is relatively easy and comfortable for the installer to install a band clamp, such as around wiring or pipes. The objects to be banded are conveniently accessible and the environment is comfortable. However, outdoor installations can involve extreme environmental conditions. It may be cold, hot, daytime, nighttime, stormy or calm. In addition, the location may add further difficulty or complexity to the installation, such as ocean-based oil drilling platforms and pipe laying barges. The installations may occur above water or below water. The installer may be in a dive suit or suspended in a harness high above the platform or ocean. All of these factors, and others, can make installation difficult.

In connection with off shore oil drilling platforms, large bands and seals may be used to band or secure strakes, insulation, impact protectors, buoyancy elements, saddles and other large sized objects. With these and other similar large scale objects and as shown in FIG. 1, an installer typically utilizes a large coil of unformed banding material 10 and cuts custom lengths 12 of the banding material as is needed for each job. The installer will also have a supply of seals 14 used with the band to secure the band around the object or objects to be secured. The installer will further have a relatively large power tool that is used to cinch or tighten the band and to deform the seal and overlapping band to thereby clamp or band the secured objects. Because of environmental and/or location-specific difficulties or complexities, dropping a seal creates frustration for the installer, increases installation time and adds to increased costs. The cost associated with the banding operation is further increased if the seal is lost and creates environmental problems if the seal is lost in the ocean. Therefore, as represented in FIG. 2, in some instances, the installer will manually bend one end 18 of the cut band material back onto itself at a ninety degree or greater angle $\alpha$ and load the seal on the opposite end 16 of the band. In this manner, the seal is maintained on the band in a limited fashion. It will not fall off the bent end of the band, but is not completely captured since it may easily fall of the other end of the band, particularly as the orientation of the band changes during handling or installation. Indeed, when assembling the band and seals on location, seals are dropped, or are assembled onto the band in an upside down orientation, with the seam formed by the overlapping legs of the seal forcing outwardly, which results in a weaker clamp. In the latter context, the installer should remove and reorient the seal on the band. However, additional handling of the band and seal increases the likelihood that the seal will be dropped or dislodged from the band.

Cutting custom lengths of band on location also results in wasted materials, potential environmental problems, health risks from the sharp edges of cut banding material and increased labor time. Because installers do not want to redo a job, particularly in adverse conditions, they will typically cut a piece of band at an excessive length, longer than needed, and will not take time to avoid or reduce sharp edges 20 on the cut band. This can create health risks for the installer and others who have to work around and in the vicinity of the cut band. Once the band is secured in place, as shown in FIG. 3, the excess length 22 is cut off, leaving a length of band that has no use and must be discarded. The excess length may be greater than necessary to accomplish the banding task and, therefore, results in waste. The excess piece of material may also be dropped and need to be retrieved, or lost in the ocean. However, from the installer's perspective, this is preferable to cutting a length of band that is too short and having to cut a second length of band to complete the job, resulting in the discarded first band which was too short and the excess length cut from the second band.

Even if the seal is not assembled correctly and is not dropped from the band, actual installation also can be problematic. After the band is wrapped around the objects to be banded, the free end 16 of the band must be inserted into seal 14 above the preformed end 18 of the band. However, little space may exist between the seal and the preformed band portion 18 for inserting the free end 20, and the rough or unevenly cut leading edge 20 of the band may not easily fit in the available space or may actually prevent or seriously inhibit insertion. In addition, depending upon the installation site, there may also be difficulties in positioning the crimping tool relative to the seal and overlapping band portions, which can lead to an improperly crimped seal. More particularly, the crimping tool engages the seal and overlapping band portions along the side or lateral edges of the seal and band. However, it is preferable that the bent portion 18 of the band not be engaged by the crimping tool. Avoiding the bent portion 18 may be difficult given the close proximity of the bent portion 18 of the band to the seal during crimping. As can be imagined, these problems can be exacerbated in adverse environments and in awkward installation locations.

To address these issues and to reduce the time of installation, some large bands are now available in precut lengths with one end of the band preformed and a seal preassembled on the band as previously described and as is generally represented in FIG. 2. Unfortunately, the seals are not truly captured. During shipping and transport, numerous preformed and preassembled bands and seals are placed in the same container. As a result, many of the preassembled band and seal combinations become entangled or are further bent in unintended ways under the weight of the other bands and seals in the shipping container, causing the seals to become dislodged during transport or as the intertwined bands are removed from the container. Moreover, as the assembled bands and seals are removed from a container and are otherwise handled as part of shipping and installation, the bent end 18 may become unbent and the seal is susceptible to falling off either end of the band. Therefore, little advantage is achieved in preforming or pre-assembling the bands in this manner.

SUMMARY OF THE INVENTION

The needs described in the preceding paragraphs have existed for a long time without solution or resolution. The present invention satisfies this long-felt need. The present invention relates to a high strength, pre-cut free end band and seal, generally comprising a pre-cut band of a predetermined length having a first free end and a pre-formed second end that forms a substantially closed loop of band material and a seal captured within the loop of band material that, when subjected to a clamping force, create a finished band clamp that restrains or secures one or more objects. Preforming the band and providing bands at predetermined lengths prevents wasted material and reduces labor costs. The pre-formed loop of band material is preferably spring-loaded to retain a seal within the loop of material so that a seal may be preassembled with a band for packaging, shipping and use in the field, as a complete unit. The loop is also elastic to the extent the seal may be manually removed without permanent change to the preformed loop. The loop of band material may further include a capture element to inhibit accidental or unintended removal or disassembly of the seal from the band. Capture of the band and seal facilitates efficiency in the field by eliminating the need for the field worker to assemble bands and seals in the field. It further promotes preassembly because the probability of dislodging the preassembled seal during shipment and installation is reduced. Releasably capturing a seal in an elastic rather than inelastic way, such that the seal cannot be accidentally dislodged from the band, but can be manually removed from the band, reduces frustration on the part of the installers, reduces installation time, reduces potential environmental problems and reduces wasted material.

In more than one embodiment of the present invention, the pre-formed second end of the band also positively positions the seal relative to the band to facilitate insertion of the free end of the band into the seal and to facilitate the action of the crimping tool to engage and deform the seal and overlapping band material. Positively positioning the seal relative to the band for optimized engagement by a power crimping tool also saves time and provides a more consistent clamped band. Each of these advantages facilitates end use application in the field where circumstances and environmental conditions may be challenging and adverse.

DESCRIPTION OF THE DRAWINGS

Several drawings have been developed to assist with understanding the invention. Following is a brief description of the drawings that illustrate the invention and its various embodiments.

FIG. 7 is a front elevation view of a metal blank partially formed into a seal.

FIG. 8 is a three-quarter perspective view of a seal.

FIG. 9 is a top plan view of the embodiment of FIG. 8.

FIG. 10A is an end elevation view of the embodiment of FIG. 8.

FIG. 10B is an end elevation view of an alternative embodiment of the seal shown in FIG. 10A.

FIG. 17 is a partial elevation view of a tool used to crimp a seal about a band.

FIG. 18 is a side elevation view of a crimped seal and band.

FIG. 19 is a top plan view of the embodiment of FIG. 18.

While the following disclosure describes the invention in connection with those embodiments presented, one should understand that the invention is not strictly limited to these embodiments. Furthermore, one should understand that the drawings are not necessarily to scale, and that in certain instances, the disclosure may not include details which are not necessary for an understanding of the present invention, such as conventional details of fabrication and assembly.

DETAILED DESCRIPTION

Figure 1:
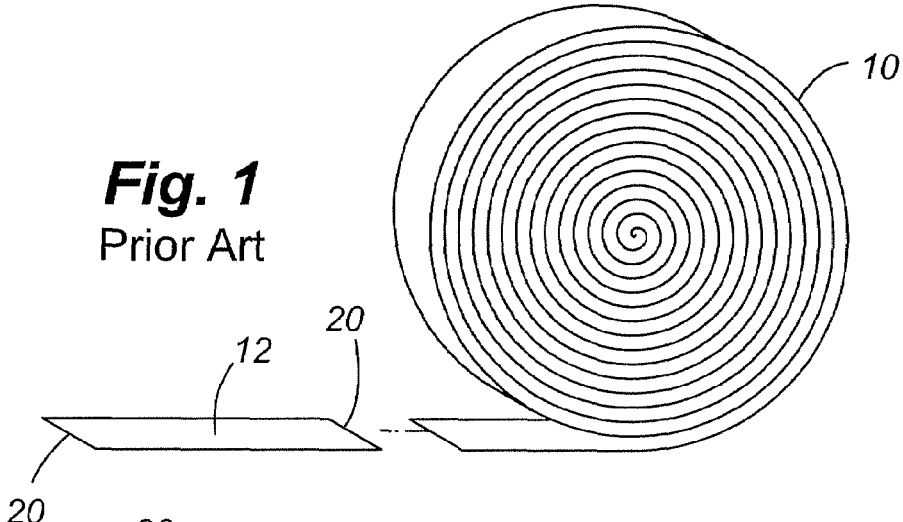
Fig. 1 Prior Art
FIG. 1 is a perspective view of a coil of band material.
Figure 2:
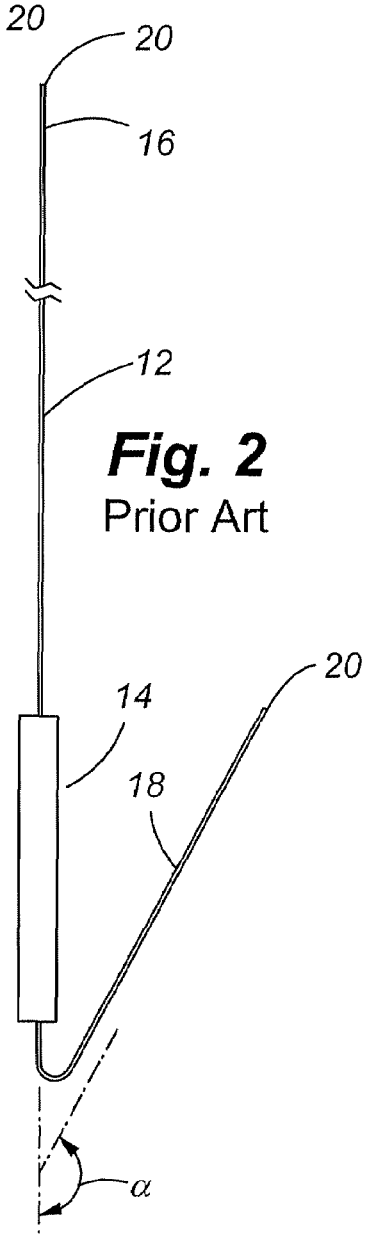
Fig. 2 Prior Art
FIG. 2 is a plan view of a length of band material with a seal assembled thereon.
Figure 3:
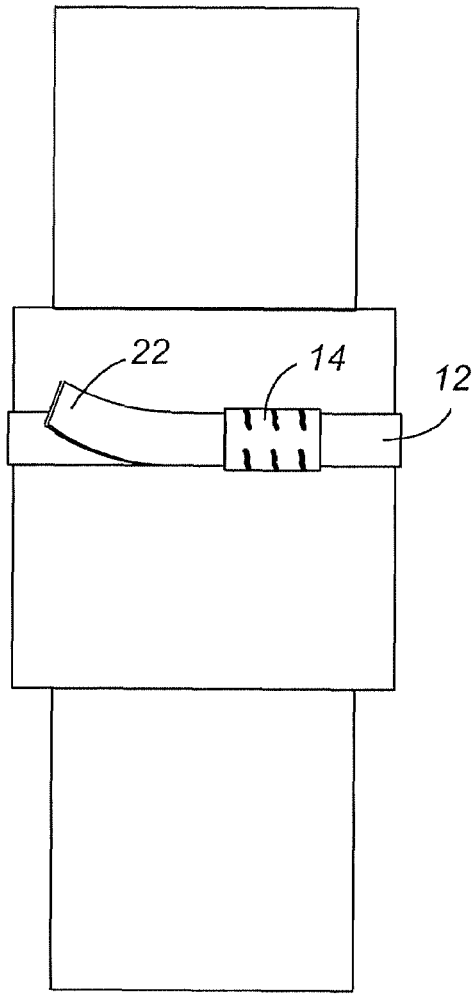
Fig. 3 Prior Art
FIG. 3 is a plan view of one object secured to a second object by a band and seal combination.
Figure 4:
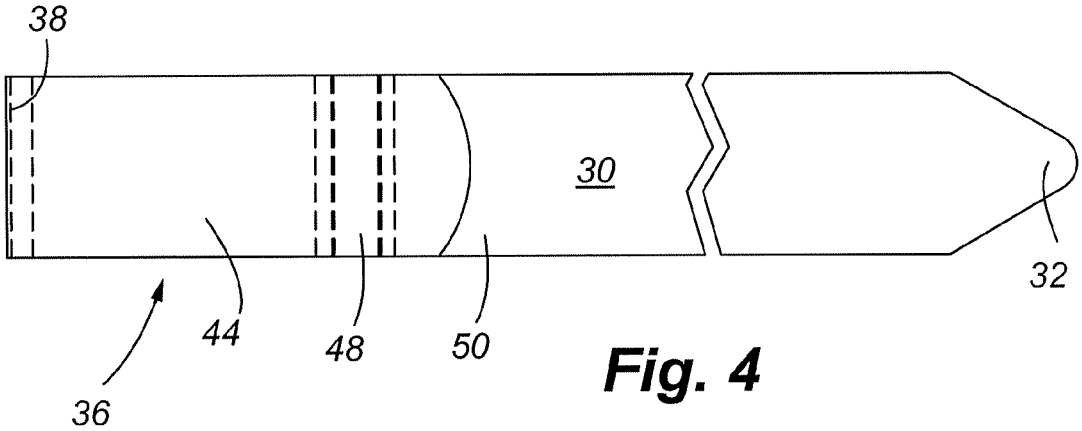
FIG. 4 is a top plan view of one embodiment of a preformed band of the present invention.
Figure 5:
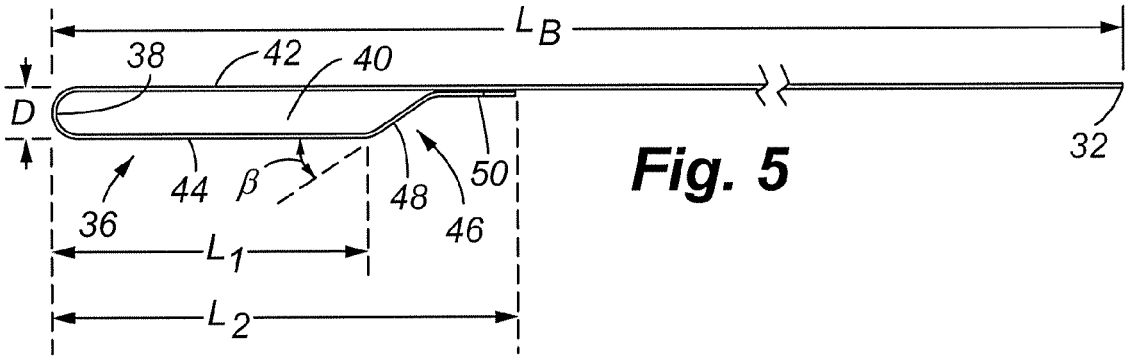
FIG. 5 is a front elevation view of the embodiment of FIG. 4.
Figure 6:
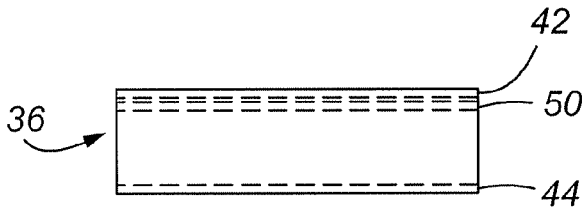
FIG. 6 is an end elevation view of the embodiment of FIG. 4.

A preformed band 30 of one embodiment of the present invention is shown in FIGS. 4-6. The illustrated band shown is 1.25 inches wide, although depending upon the application, it may be narrower or wider. For example, it may be 0.75 inches wide or 1.5 inches wide. The band is approximately 0.030 inches thick, although depending upon the application it may be thinner or thicker. An acceptable range of band thickness is approximately 0.010 to 0.044 inches, and is preferably 0.030. A seal is shown in FIGS. 7-10B. Preferably, the band and seal are made of stainless steel or other materials capable of withstanding not only the tensile forces applied to the band to secure or restrain banded objects, but to also withstand a large range of environmental conditions. Examples of suitable materials include Inconel® 625, Monel® 400, and Incoloy® 27-7SMO made by Huntington Alloys Corporation and AL-6XN made by Allegheny Technologies, Inc.

As shown in FIG. 5, the length of the band 30, dimension $L_B$, is variable depending upon the end use application. The bands are intended to be cut in predetermined lengths depending upon the end use. This substantially reduces waste in time and resources caused when the bands are cut in the field as field installers tend to liberally cut lengths of band from rolls of band material to avoid the time needed for the installers to accurately measure the needed length. The free end 32 has a rounded radius for safety and to facilitate insertion and passage of the free end through the seal 34 and above the opposite or preformed end of the band 36. As shown in FIG. 5, the pre-formed end 36 is bent approximately 180 degrees to form a substantially closed loop of band material. A load bearing surface 38 and space 40 are formed between the overlapping portions 42, 44 of the preformed end of the band. The overlapping portions are generally parallel to and spaced from each other be a distance D. This distance D, at a minimum, is approximately 0.060 inches for the embodiment of FIG. 10B, and is approximately 0.110 inches for the embodiment of FIG. 10A. Preferably, dimension D is approximately 0.30 inches. In this embodiment, the pre-formed end 36 further comprises a tail section 46 which substantially closes the loop of band material. The tail section includes a first band portion 48 that is bent or angled at an angle β toward the upper portion 42 of the band, and a second band portion 50 that is parallel to and may engage or contact the upper portion 42 of the band. In this embodiment, β is approximately 34 degrees, the length $L_1$ of lower band portion 44 is approximately 2.19 inches +/−0.05 inches, and the length $L_2$ is approximately 3.2 inches +0.1 or −0.05 inches. The tail portion 46 permits a seal to be pre-assembled with a band into a complete unit prior to installation. By forming a substantially closed loop of band material, the seal 34 is generally captured within the loop of band material. The elastic resiliency of the load bearing portion 38 in combination with the configuration of the tail portion 48 allows the closed loop to be closed or substantially closed and thereby capture the seal 34. A captured seal is one that is generally inhibited from being accidentally or unintentionally removed, such as when the orientation of the band is changed. It should be appreciated that the terms upper and lower, or any other relative description of location are solely for convenience and in reference to the figures, and are not intended as limitations on the scope of the invention.

Preassembly of the band and seal can occur at most any time or place, even in the field, prior to installation. A preassembled band 30 and seal 34 are shown in FIGS. 11-15. However, it may be preferable to pre-assemble seals with band as part of the manufacturing process when band material is cut and bent to form the preformed end 36. This can be accomplished in an automated manner and reduces labor costs by reducing manual assembly.

Figure 16:
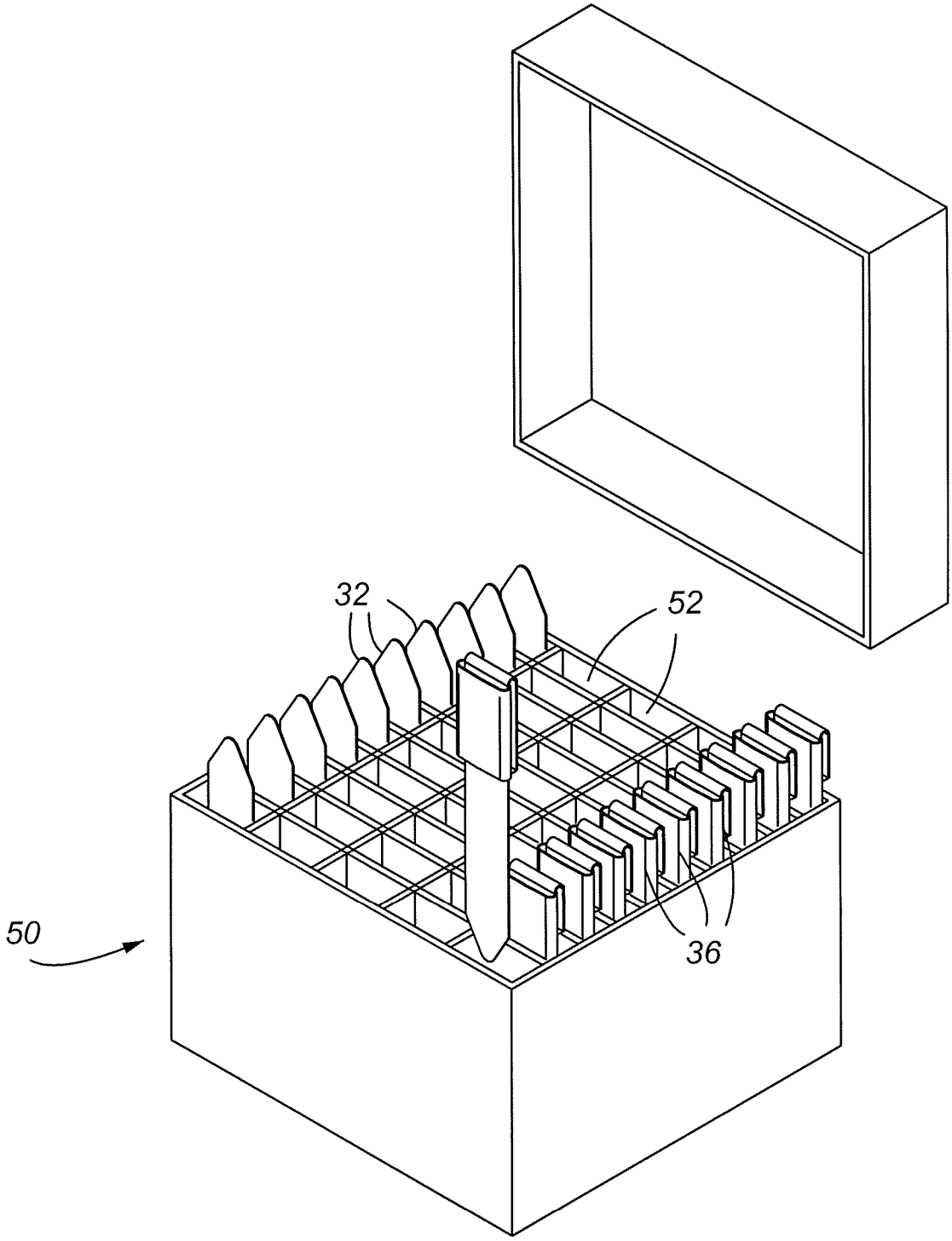
FIG. 16 is a three-quarter perspective view of an embodiment of packaging for shipping and/or storing preformed bands and assembled seals of the present invention.

Preassembly further permits the combined band and captured seal to be packaged and shipped to the field ready for end use application, saving the field installer the time and effort otherwise needed to cut the band material, pre-form the band with a closed loop of band material and assemble the seal onto the band. Indeed, specialized packaging, an exemplary version of which is shown in FIG. 16, can be used that positions the preassembled bands and seals in a manner that most easily permits the field installer to remove the preassembled band and seal from the packaging with the least amount of complications or interference from other bands. The packaging may also be designed to facilitate more efficient installation in the field. For example, the preassembled bands and seals could be oriented in a parallel manner in a package 50, in individual sleeves 52 or otherwise separated from each other, that easily permits the field installer to remove the preassembled band and seal from the packaging. The bands 30 may be oriented with the free end 32 or the pre-formed end 36 facing outward of the package. The package 50 may be oriented to optimize the position of the bands for the installer, e.g., with the bands positioned vertically, horizontally or at some other orientation. Orienting all of the band and seals in the same configuration simplifies installation. Moreover, conditions in the field may be adverse for any number of reasons and eliminating assembly steps, pre-locating a seal for every band, and uniformly orienting all of the band/seal combinations in the same position simplifies installation.

One embodiment of the seal 12 is illustrated in FIGS. 7-10A. In this embodiment, the seal initially comprises a rectangular piece of metal. The rectangular piece of metal is bent to form a seal 34 having three portions. The upper portion 60 may be stamped, etched or otherwise marked with desired indicia, including but not limited to model or part numbers, trademarks or company names. In this embodiment, illustrated in FIG. 9, the length $L_1$ of the seal is approximately 2.25 inches, and the width $W_1$ is between approximately 1.422 and 1.454 inches, for use with a band having a width of approximately 1.25 inches. The thickness of the material is approximately 0.030 inches. Two leg portions 62 and 64 fold under the upper portion 60 and overlap at 66 to form the seal 34. As shown, leg 64 is longer than leg 62 to permit it to overlap leg 62. As shown in FIG. 7, leg 62 is approximately 0.933 inches (dimension $L_1$) and leg 64 is approximately 1.044 inches (dimension $L_2$) before bending. As shown in FIG. 10A, the seal may be formed with an angle $\gamma_1$ between the end wall 68 and the leg 62 and an angle $\gamma_2$ between the end wall 68 and the leg 64. The two angles $\gamma_1$ and $\gamma_2$ are not identical, given that leg 62 is positioned inside leg 64. This is the general shape of prior art seals. In the prior art, the angles $\gamma_1$ and $\gamma_2$ are between approximately ten and fifteen degrees. Alternatively, as shown in FIG. 10B, after bending the legs 62, 64 may also be generally parallel to the upper portion 60. The seal is sized to meet the required retained force expected of the seal based upon the end use application of the band. The material used to make the seal also contributes to the ultimate strength of the seal and the retained force of the clamped band and seal. The upper portion 60 may be rectangular or square once it is bent into the shape of a seal. The dimensions of a blank used to form the seal shown is approximately 2.25 by 3.170 inches.

For installation, the band 30 is wrapped around one or more objects that are to be secured or banded, the free end 32 of the band 30 is inserted into the seal 34, beneath the upper portion 60 of the seal and above the upper band portion 42 of the pre-formed end 36 of the band. The free end 32 and the upper band portion 42 create an overlapping portion inside the seal. A clinching tool grasps and pulls the free end of the band through the seal until the band is properly tightened against the objects to be secured. The tool applies pressure against the seal and, in turn, the seal is forced against the load bearing surface 38 of the pre-form end. The tool may be automated, such as pneumatic or electric, and apply a predetermined tensioning force, or it may be manually operated where the installer determines the amount of tension to apply. The seal 34 and overlapping portions 32, 42 of the band are then deformed to lock the band in its then current position. FIG. 17 illustrates the operative portion of a deforming a crimping mechanism 70. In essence, a pair of jaws 72 engage the seal and the overlapping band portions from the sides. Stationary anvils 74 are positioned on the surface of the top portion 60 of the seal 34 and the tips 76 of the jaws 72 comprise movable anvils 78. As the jaws 72 rotate inwardly about pivot points 80, the anvils 74, 78 cooperate to deform the seal 34 and overlapping bands 32, 42 to create a rigidly crimped band. A deformed and locked seal and band is shown in FIGS. 18 and 19.

Figure 20:
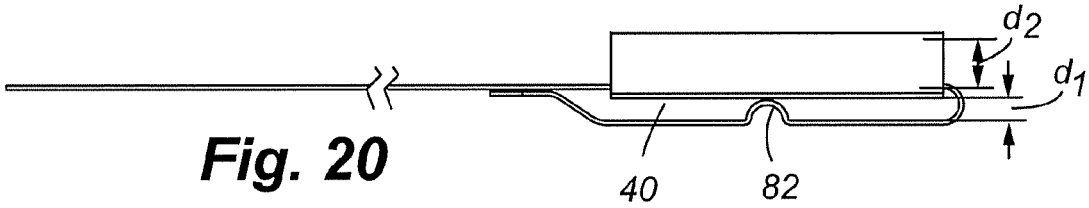
FIG. 20 is a side elevation view of an alternative embodiment of the present invention.
Figure 21:
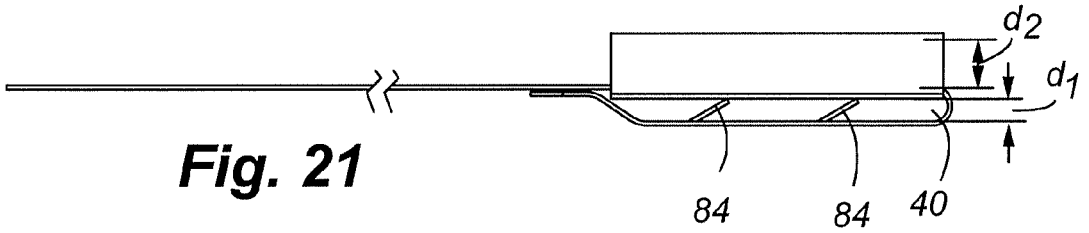
FIG. 21 is a side elevation view of an alternative embodiment of the present invention.
Figure 22:
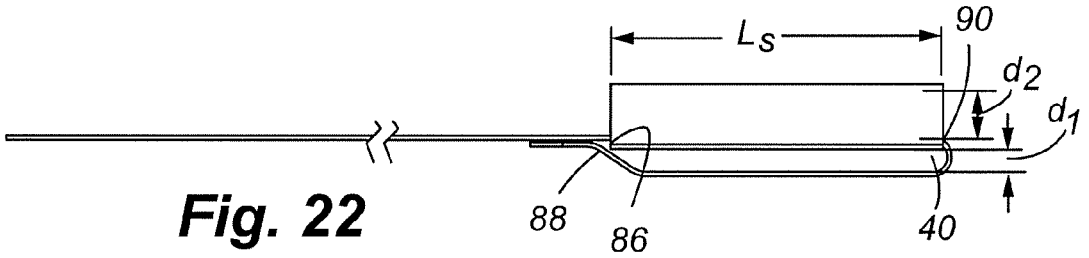
FIG. 22 is a side elevation view of an alternative embodiment of the present invention.

It is preferred that the jaw tips 76 do not engage and crimp the bottom portion 44 of the band. Including the bottom portion 44 within the crimping tool jaw tips 76 may cause the seal to crimp improperly or in a less secure manner. This may cause the band and seal to prematurely loosen. It may further cause the seal to be formed in a position raised off of the surface of the clamped objects, potentially securing the band at too large a circumference where it is more loose than it should be and also increasing the risk of a person or object being damaged from contacting the seal. Accordingly, in another aspect of the invention, steps can be taken to elevate or space the seal from the bottom portion 44 of the band to facilitate placement of the crimping jaws 76 such that the bottom portion 44 of the band is not engaged and crimped by the crimping mechanism. As shown in FIG. 20, one or more ridges or bends 82 may be formed in the bottom portion 44 of the band. These ridges 82 will engage the legs 62, 64 of the seal and increase the space $d_1$ between the legs and the lower portion 44 of the band. Alternatively, rather than forming a ridge across the width of the band, tabs 84 may be cut or notched in the lower portion 44 of the band and bent into the space 40 to create an alternative way to bias the seal 34 away from the bottom portion 44 of the band (FIG. 21). It should also be appreciated that these ridges and/or tabs could be formed in the upper portion 42 of the band and engage the upper portion 60 of the seal and equally create spacing between the legs 62, 64 of the seal and the bottom portion 44 of the band. The direction in which the tabs are bent could also create an interference. Depending upon their location and the direction of the bend, the tabs might interfere with assembly or disassembly of the seal and band, insertion of the free end 32 of the band into the seal or movement of the jaw tips 76 during crimping. Therefore, care should be taken in determining the location, size and direction of the tabs. It will also be appreciated that increasing the space $d_1$ will also increase the space $d_2$ between the upper portion 42 of the band and the upper portion 60 of the seal. Increasing the space $d_2$ will facilitate insertion of the free end 32 of the band into the seal and simplify installation. A further method of biasing the seal away from the bottom portion 44 of the band to create a space for the anvil jaw tips 76 is illustrated in FIG. 22. There, the length of seal $L_s$ is used to determine the dimensions of the closed loop portion 36 of the band. The distance between the load bearing surface 38 and the first band portion 48 of the tail portion 36 coincides with the length of the seal $L_s$ such that a first end 86 of the seal engages the first portion 48 of the band at a position 88 separated from the lower portion 44 of the band and the opposite edge 90 of the seal engages the load bearing surface 38. This configuration also increases the spaces $d_1$ and $d_2$.

A further alternative to increasing the spaces $d_1$ and $d_2$ is illustrated in FIG. 10A. As shown, the legs of the seal may be formed with an angle $\gamma$ between the end walls 68 and the legs 62, 64 such that the legs are not parallel to the upper portion 42 of the band. The angle of the legs $\gamma_1$ and $\gamma_2$ effects the position of the upper portion of the seal 60 relative to the upper band portion 42 (dimension $d_2$) and the separation between end walls 68 of the seal and the bottom portion 44 of the band (dimension $d_1$). It is believed that when the angles $\gamma_1$ and $\gamma_2$ are between 10 and 15 degrees, the spaces $d_1$ and $d_2$ are optimally increased compared to the seal of FIG. 10B and the embodiment of FIG. 14. The increase in space facilitates insertion of the free end 32 of the band into the seal, and also facilitates correct positioning of the jaw tips 76 relative to the space between the legs 62, 64 of the seal and the bottom portion 44 of the band to which enhances the probability of optimally crimping the seal and overlapping band portions.

Figure 11:
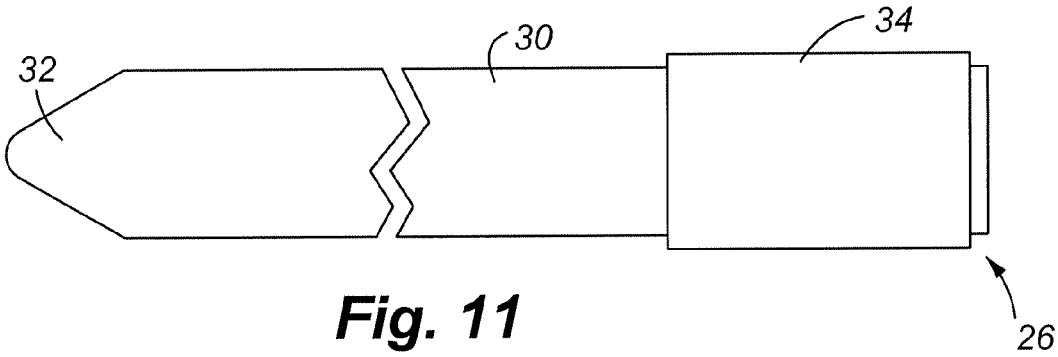
FIG. 11 is a top plan view of one embodiment of a preformed band and assembled seal of the present invention.
Figure 12:
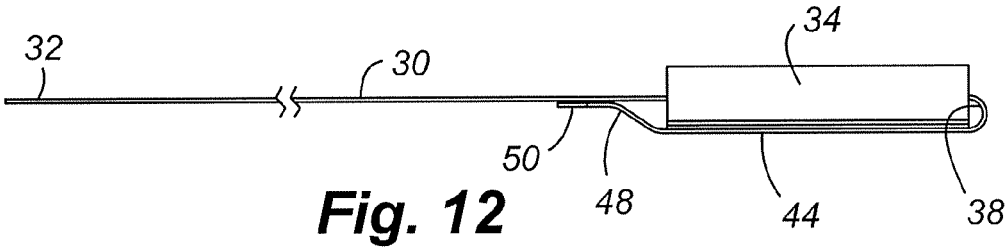
FIG. 12 is a side elevation view of the embodiment of FIG. 11.
Figure 13:
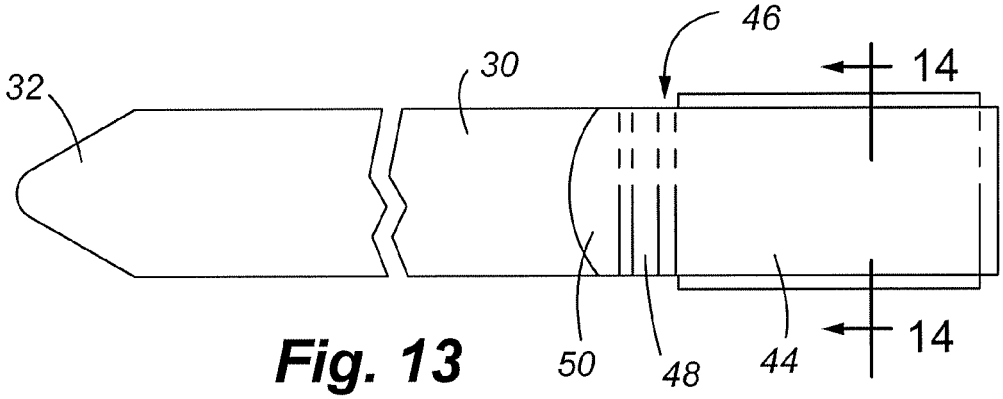
FIG. 13 is a bottom plan view of the embodiment of FIG. 11.
Figure 14:
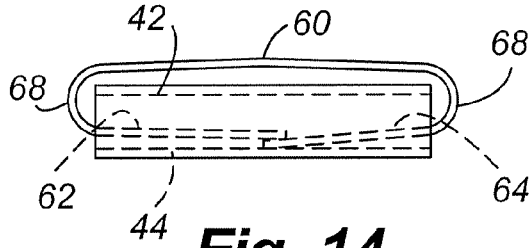
FIG. 14 is an end plan view of the embodiment of FIG. 11.
Figure 15:
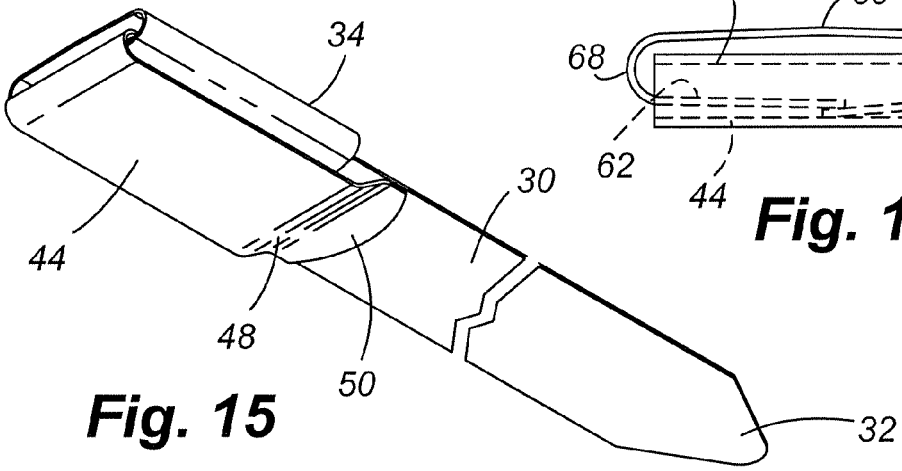
FIG. 15 is a three-quarter perspective view of the embodiment of FIG. 11.

Another feature of the present invention is the improved free end 32 of the band. As shown in FIG. 11, the free end 32 is rounded to improve insertion into the seal and to eliminate sharp edges formed when the band is cut in the field by installers.

A further feature is of the present invention is the reduction of waste or scrap. By fabricating the band in predetermined or set lengths, depending upon end applications, waste is reduced. Waste is also reduced by reducing the number of lost seals.

Another feature of the invention is uniformity in creating the load-bearing surface 38 of the seal 34. As discussed above, the radius forming the load bearing surface 38 is previously fully or partially manually formed in the field while the field installer is forming and securing the band to one or more objects. With the pre-formed band of the present invention, formation of the load-bearing surface occurs in the factory, under ideal conditions, rather than in the field. A consistently formed load-bearing surface, with a uniform radius, contributes to a consistently formed clamp. Preforming the bands and seals also provides uniform and optimized spacing $d_1$ and $d_2$ between the band and seal which also contributes to optimal crimping of the band and seal.

As noted previously, it is desirable to capture the seal within the preformed end 36 of the band to inhibit unintentional or accidental dislodging of the seal from the band. The embodiment of FIGS. 11-15 is an improvement over known methods. While one of skill in the art may initially think it would be an added benefit to permanently secure the seal 32 within the pre-formed end 60 of the band after assembly, such as by spot welding or otherwise securing the tail portion 46 to the upper portion 42 of the band, in some instances, it is desirable to substitute a different seal for the preassembled seal, or some installers may prefer to assemble the seals and bands themselves. Therefore, it is preferred that the capture mechanism must still permit the seal to be removed. Therefore, it is preferred that the closed loop be formed in a way that it may be elastically opened to assemble or disassemble the seal without negatively affecting the ability of the closed loop to capture the seal.

Figure 23:
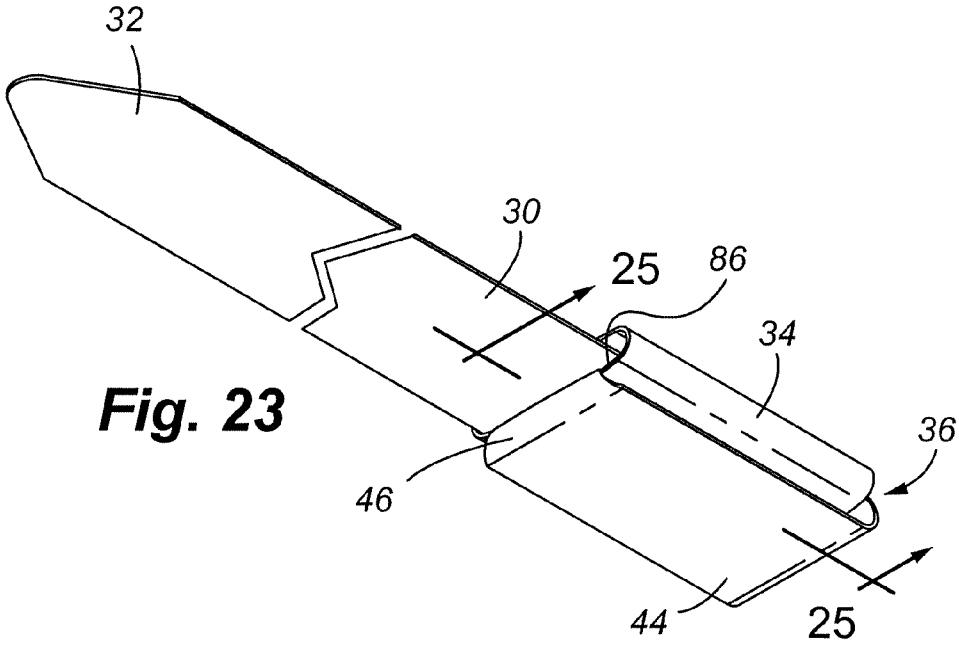
FIG. 23 is a three-quarter perspective view of an alternative embodiment of the present invention.
Figure 24:
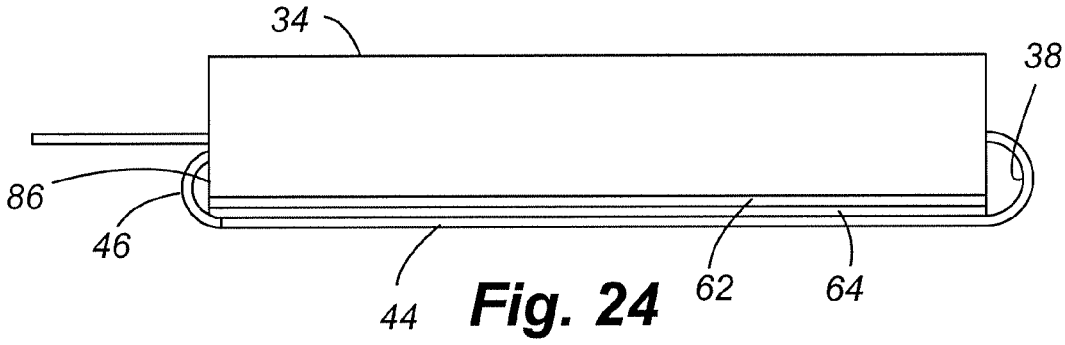
FIG. 24 is a partial side elevation view of the embodiment of FIG. 23.
Figure 25:
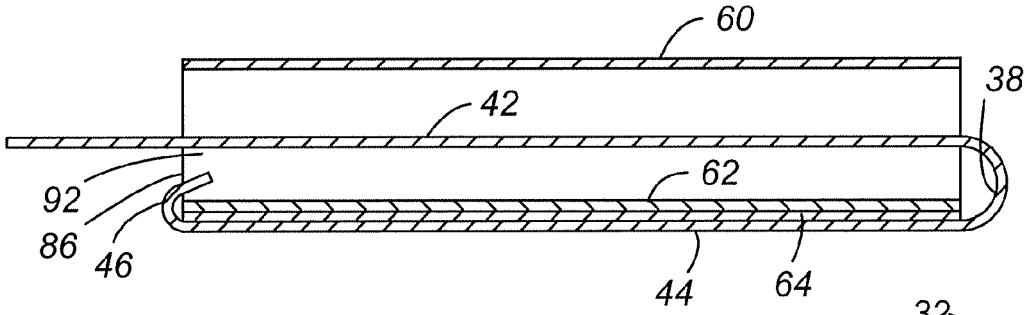
FIG. 25 is a cross-sectional view taken along the lines 25-25 of FIG. 23.
Figure 26:
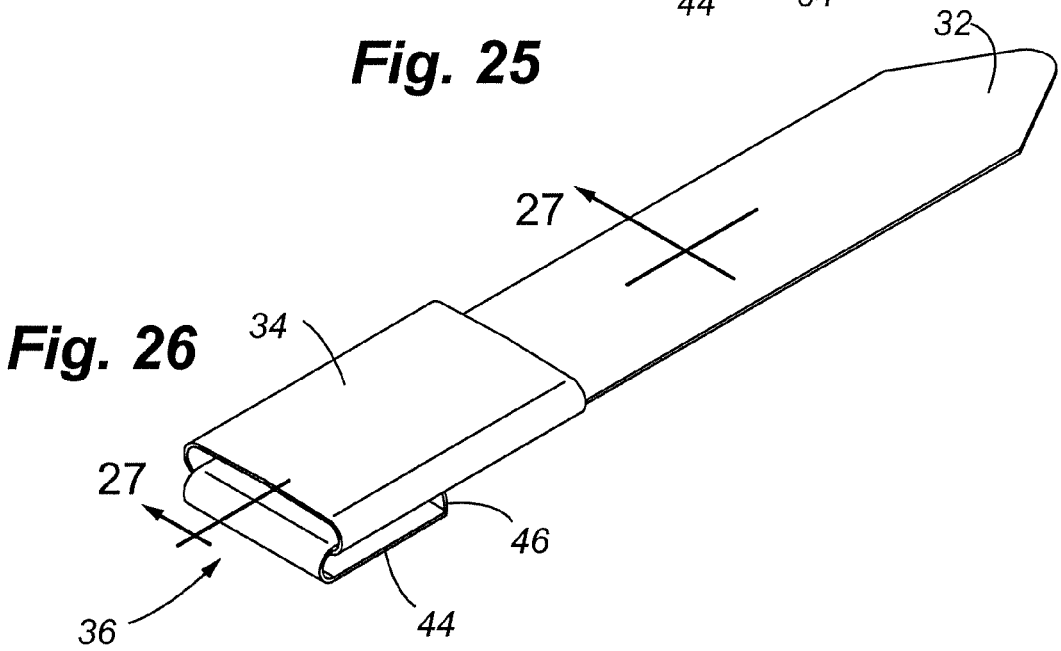
FIG. 26 is a top perspective view of an alternative embodiment of the present invention.
Figure 27:
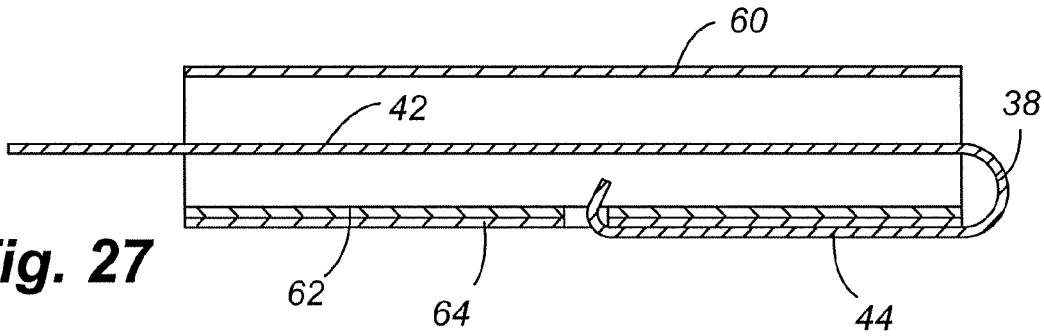
FIG. 27 is a cross-sectional view taken along lines 27-27 of FIG. 26.
Figure 28:
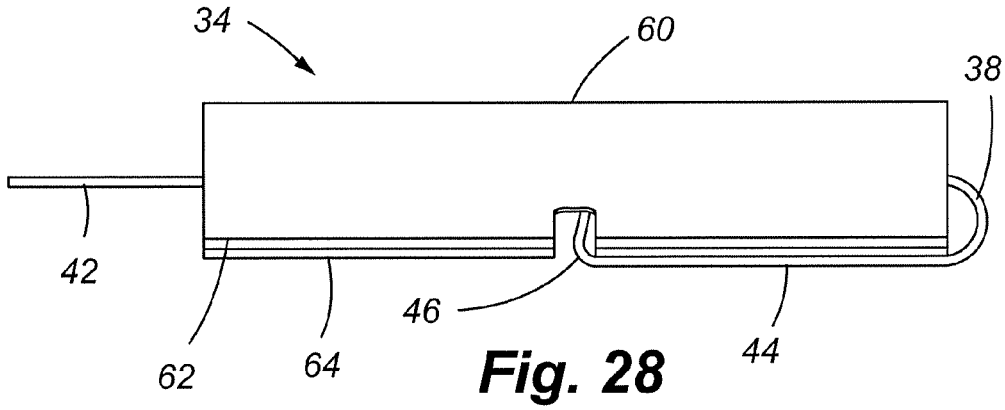
FIG. 28 is a partial side elevation view of the embodiment of FIG. 26.
Figure 29:
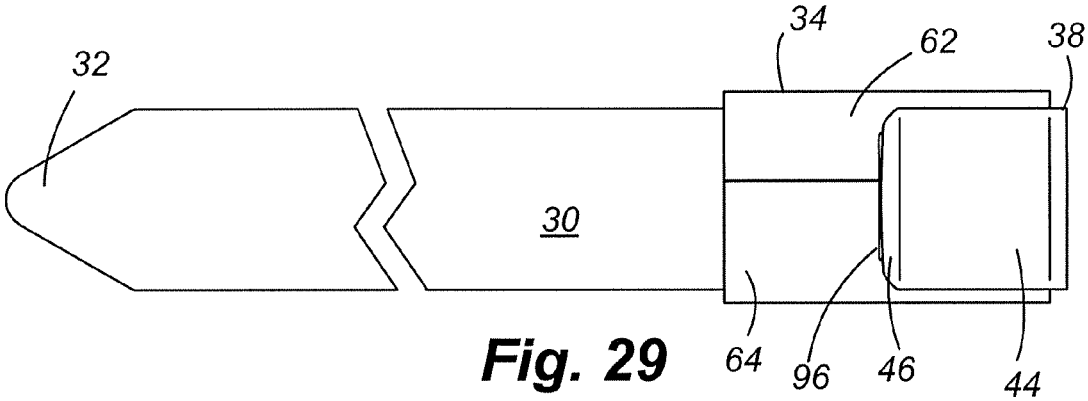
FIG. 29 is a bottom plan view of the embodiment of FIG. 26.
Figure 30:
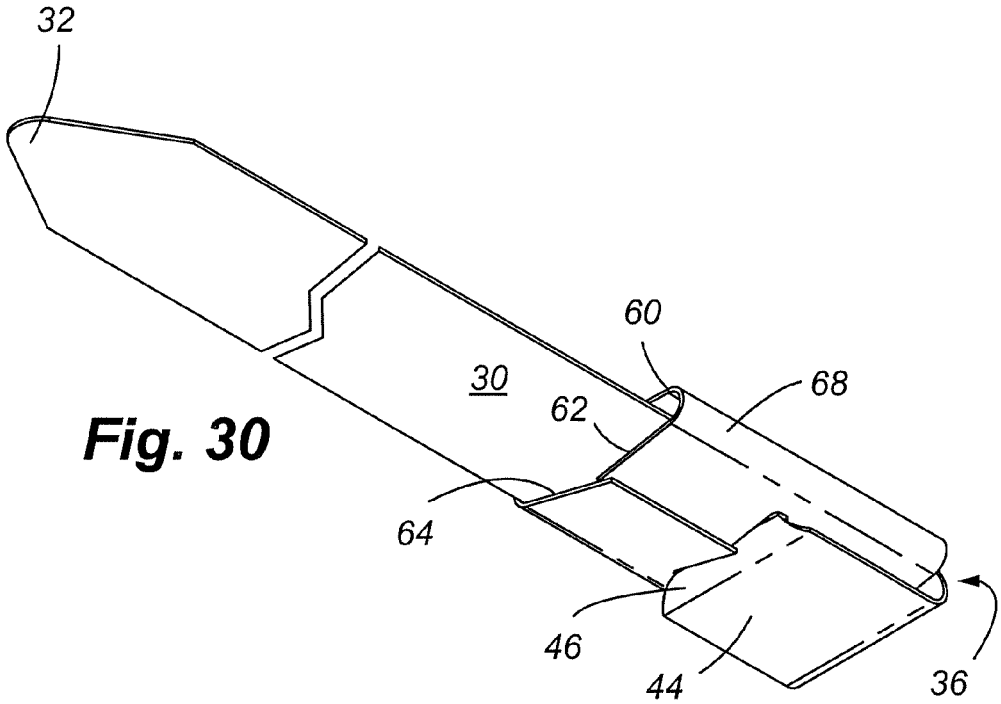
FIG. 30 is a bottom perspective view of the embodiment of FIG. 26.

One alternative embodiment of a releasable capture mechanism is shown in FIGS. 23-25. In this embodiment, the tail portion 46 is formed to tuck into the space 92 between the upper portion 42 of the band and the legs of the seal 62, 64 at the edge 84 of the band. The band may have a constant radius, as shown, or may have flat segmented portions. In any event, the tail portion 46 engages the edge 86 of the seal and prevents the seal from being easily dislodged from the preformed end 36 of the band. However, the seal may still be removed by separating the bottom portion 44 of the band from the upper portion 42 of the band to remove the tail portion 46 from the space 92 to permit intentional removal of the seal.

Figure 31:
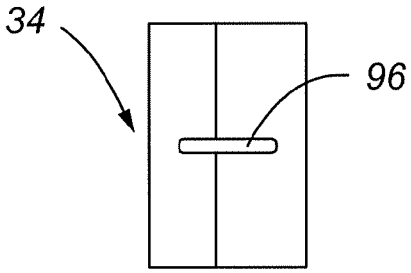
FIG. 31 is a bottom plan view of an alternative embodiment of a seal.
Figure 32:
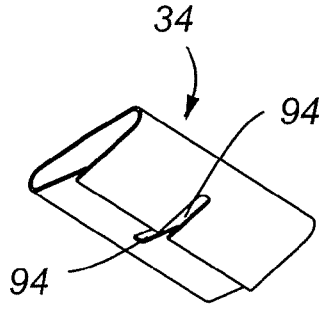
FIG. 32 is a three-quarter perspective view of the embodiment of FIG. 31.

A second alternative embodiment is illustrated in FIGS. 26-32. Here, as shown in FIG. 32, a pair of aligned slots 94 are formed in the legs 62, 64 of the seal. When the legs are bent inwardly, the slots join to form a single slot 96 in the seal, as seen in FIG. 31. The tail end 46 of the lower portion 44 of the band is bent to extend into the slot 94 and thereby prevents the seal 34 from being accidentally dislodged. However, the seal can be removed by separating the lower portion 44 of the band from the upper portion 42 of the band to remove the tail portion 46 from the slot 96.

Figure 33:
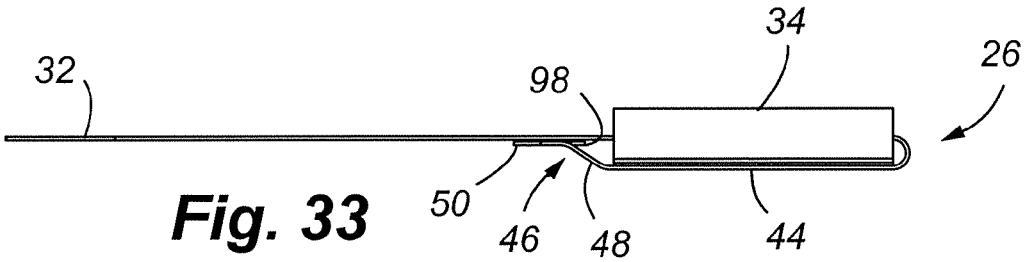
FIG. 33 is a side elevation view of an alternative embodiment of the present invention.
Figure 34:
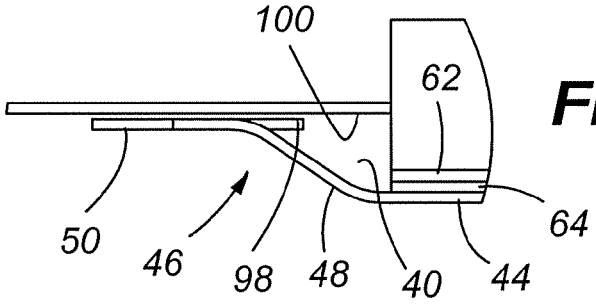
FIG. 34 is a partial and enlarged side elevation view of the embodiment of FIG. 33.
Figure 35:
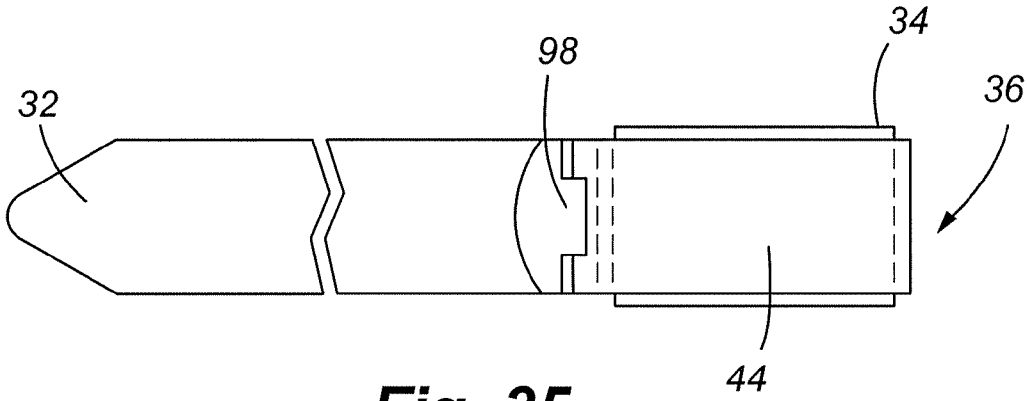
FIG. 35 is a bottom plan view of the embodiment of FIG. 33.

A third alternative embodiment is illustrated in FIGS. 33-35. Here, a protrusion or tab 98 is formed in the first band portion 48 of the tail portion 46 of the band. The tab 98 may be formed in any number of ways, such as by stamping. It may be a flat tab, as shown, or a dimple having a variety of shapes, or some other protrusion that inhibits accidental dislodging of the seal. As shown in FIG. 34, the tab 98 extends into the space 40 along and generally parallel to the bottom surface 100 of the upper portion 42 of the band 30. In this position, tab 98 will engage the edge 86 of the seal and prevent it from dislodging from within the space 40 formed by the loop of band material. It may also protrude perpendicularly from the length of band 48 or at some other effective angle.

The preformed and preassembled band and seal may be manufactured and assembled in an automated process. Coils of band material may be automatically cut in predetermined lengths. One edge may be cut and machined to provide a rounded edge, and the opposite end of the band may be formed into any one of the closed loops disclosed herein or into an equivalent preformed stated. Similarly, the seals may be automatically formed from stock material and assembled onto the preformed band. It is further contemplated that the preformed and preassembled bands and seals may be loaded into customized packaging where the design or configuration of the packaging is based upon individual customer specifications or is configured for easy removal of the preformed and preassembled bands as, for example, illustrated in FIG. 16.

The foregoing discussion of the invention has been presented for purposes of illustration and description. The foregoing is not intended to limit the invention to the form or forms disclosed herein. In the foregoing description for example, various features of the invention have been identified. It should be appreciated that these features may be combined together into a single embodiment or in various other combinations as appropriate for the intended end use of the band. The dimensions of the component pieces may also vary, yet still be within the scope of the invention. This method of disclosure is not to be interpreted as reflecting an intention that the claimed invention requires more features than are expressly recited in each claim. Moreover, though the description of the invention has included description of one or more embodiments and certain variations and modifications, other variations and modifications are within the scope of the invention, e.g. as may be within the skill and knowledge of those in the art, after understanding the present disclosure. It is intended to obtain rights which include alternative embodiments to the extent permitted, including alternate, interchangeable and/or equivalent structures, functions, ranges or steps to those claimed, whether or not such alternate, interchangeable and/or equivalent structures, functions, ranges or steps are disclosed herein, and without intending to publicly dedicate any patentable subject matter.

The present invention, in various embodiments, includes components, methods, processes, systems and/or apparatus substantially as depicted and described herein, including various embodiments, subcombinations, and subsets thereof. Those of skill in the art will understand how to make and use the present invention after understanding the present disclosure. The present invention, in various embodiments, includes providing devices and processes in the absence of items not depicted and/or described herein or in various embodiments hereof, including in the absence of such items as may have been used in previous devices or processes, e.g., for improving performance, achieving ease and\or reducing cost of implementation. Rather, as the following claims reflect, inventive aspects lie in less than all features of any single foregoing disclosed embodiment. Thus, the following claims are hereby incorporated into this Detailed Description, with each claim standing on its own as a separate preferred embodiment of the invention.

What is claimed is:

1. In combination, a. a tubular seal member comprising first, second and third portions, wherein said first portion is spaced from said second and third portions;

b. a continuous band having a predetermined length and a first end and a second end, the first end having a rounded edge, the second end having seal capture means for releasably securing said seal in a position whereby the first end of the band may be inserted into the tubular seal member and c. a biasing means associated with said seal capture means for positioning and biasing the tubular seal member a predetermined distance from said continuous band to facilitate insertion of the first end of the continuous band into the tubular seal member.

2. The combination of claim 1, wherein said capture means comprises a portion of said band engaging said tubular seal member.

3. The combination of claim 1, wherein said biasing means comprises a plurality of tabs formed in said continuous band which contact at least one of the second and third portions of said tubular seal member.

4. The combination of claim 1, wherein said biasing means positions said tubular seal member such that the first portion of said tubular seal member is spaced a greater distance from said continuous band than said second and third portions of said tubular seal member.

5. The combination of claim 1, wherein said biasing means comprises at least one protrusion formed in said continuous band.

6. A preassembled band and seal for banding one or more objects, comprising:

a. a continuous and predetermined length of band material having a first end and a second end, the second end forming a substantially closed loop of band material;

b. a seal engaged by said loop of band material such that the seal is inhibited from disengaging from said loop of band material during handling and use of the assembled band and seal, the seal comprising a first portion disposed on one side of said band and second and third portions disposed on the opposite side of said band and having overlapping edges; and c. at least one biasing member disposed on said band and engaging said seal, said biasing member adapted to position and said first portion of said seal a predetermined distance from said loop of band material.

7. The preassembled band and seal of claim 6, wherein the first portion of said seal has no apertures.

8. The preassembled band and seal of claim 6, wherein said substantially closed loop of material comprises a first and second length of band material that are substantially parallel to and spaced from one another with each having a first end interconnected by a third length of band material, and a fourth length of band material that extends from a second end of said second length of band material to form said substantially closed loop of band material.

9. The preassembled band and seal of claim 8, wherein said seal has a first end and a second end, and said fourth length of band material engages one of said first and second ends of said seal.

10. The preassembled band and seal of claim 6, wherein said biasing member is at least one ridge formed in said band.

11. The preassembled band and seal of claim 6, wherein said biasing member engages at least one of the second and third portions of said seal.

12. The preassembled band and seal of claim 6, wherein the second portion and third portion are overlapping each other and are not parallel to the first portion of said seal.

* * * * *